US006158697A

United States Patent [19]

Young et al.

[11] Patent Number: 6,158,697

[45] Date of Patent: Dec. 12, 2000

[54] RAILROAD FROG ASSEMBLY WITH LATCH HOLDBACK

[75] Inventors: Keith Young, Naperville; Stephen R. Kuhn, Richton Park, both of Ill.

[73] Assignee: ABC Rail Products Corporation, Chicago, Ill.

[21] Appl. No.: 09/251,620

[22] Filed: Feb. 17, 1999

[51] Int. Cl.[7] ..... E01B 7/00

[52] U.S. Cl. ..... 246/382; 246/274; 246/275; 246/276; 246/387; 246/389

[58] Field of Search ..... 246/275, 276, 246/257, 260, 274, 358, 382, 387, 389

[56] References Cited

U.S. PATENT DOCUMENTS

| | | | |
|---|---|---|---|
| 330,862 | 11/1885 | Wuerpel | 246/257 |
| 642,867 | 2/1900 | MacPherson | 246/257 |
| 2,036,198 | 4/1936 | Cooper et al. | 246/276 |
| 5,417,392 | 5/1995 | Wyatt | 246/257 |
| 5,806,810 | 9/1998 | Young et al. | 246/276 |

*Primary Examiner*—Sherman Basinger
*Assistant Examiner*—Frantz Jules
*Attorney, Agent, or Firm*—Thomas S. Baker, Jr.

[57] ABSTRACT

A railroad frog assembly is provided with a spring wing rail latch holdback subassembly that continuously retains the spring wing rail in a spring wing rail fully open position when activated by the wheels of a railcar traversing the frog assembly, and that automatically deactivates the latch holdback subassembly and releases the spring wing rail from retention in an open condition and for complete closing after the last railcar wheel has passed through the frog assembly.

3 Claims, 3 Drawing Sheets

FIG. 1
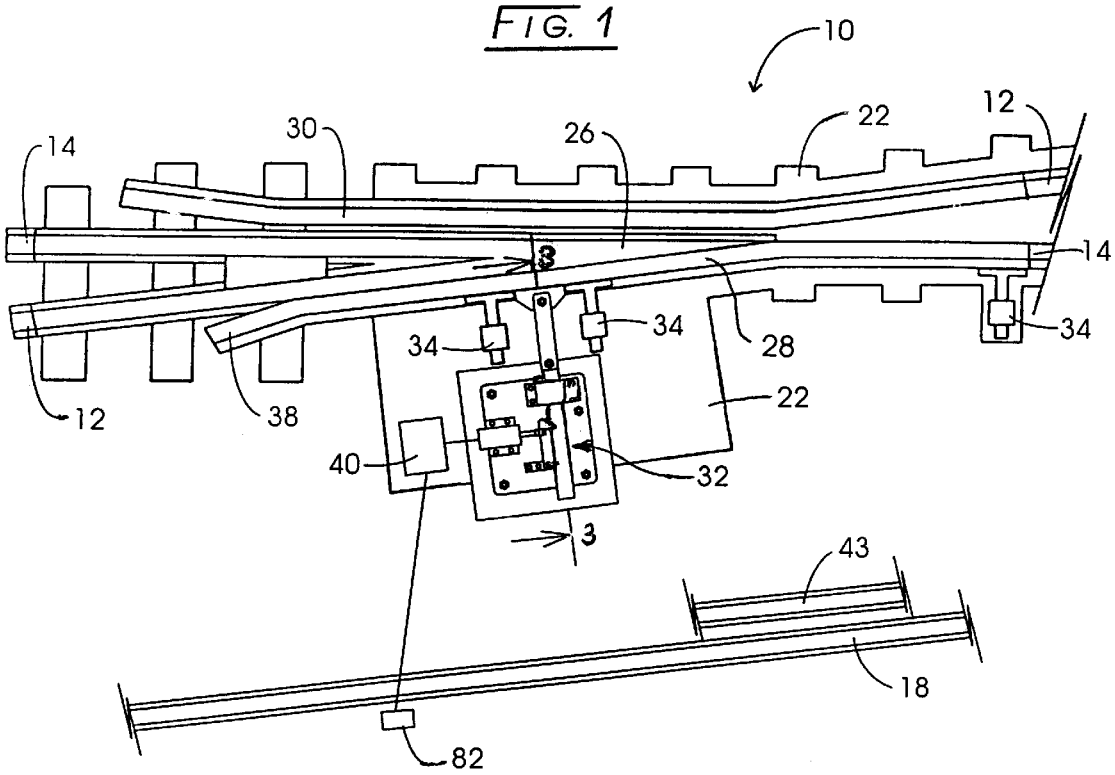
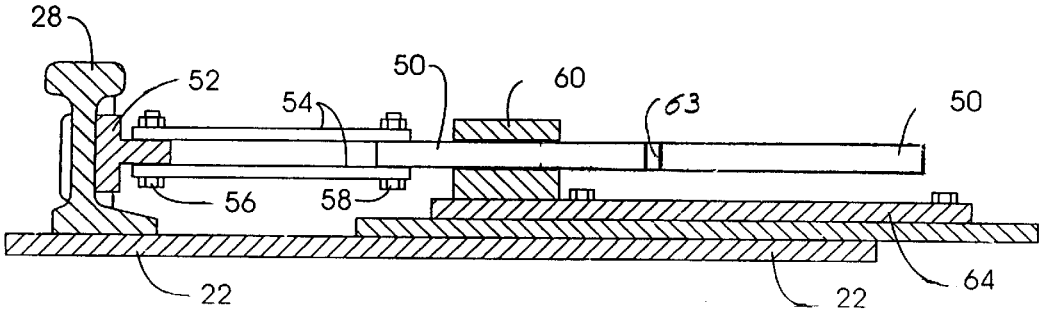
FIG. 3

RAILROAD FROG ASSEMBLY WITH LATCH HOLDBACK

BACKGROUND OF THE INVENTION

Numerous different configurations of fixed-point railroad frogs having spring-urged, flexible wing rails are utilized in railroad trackwork system intersections in the United States to provide through flangeways that enable railcar wheel flanges to cross intersecting rails without encountering flange physical interference.

The flanged wheels of railcars passing through a fixed-point railroad frog having a spring rail and in the direction of least traffic flow repeatedly open the included flexible wing rail by the widths of the wheel flanges, and wing rail flexure and any compression springs included in the frog alternately and repeatedly force a return of the wing rail toward its closed position. This repeated oscillating action of the conventional spring-urged wing rail is undesirable in terms of both the un-necessary frictional wear and the metal fatigue that are experienced.

Accordingly, a primary objective of the present invention is to provide a railroad frog construction having an included spring-urged flexible wing rail element with means for positively retaining the wing rail in its fully-opened position until after all the flanged wheels of the train set have passed through the frog.

Other objectives and advantages of the present invention, in addition to providing a railroad frog assembly construction with a significantly prolonged operating lifespan, will become apparent from a full consideration of the detailed descriptions, drawings, and claims which follow.

SUMMARY OF THE INVENTION

The railroad frog assembly of the present invention basically includes a frog fixed point, a frog flexible spring wing rail that abuts the frog fixed point when in a wing rail fully-closed position and that is spaced apart from the frog fixed point by the width of a railcar wheel flange when flexed to a wing rail fully-opened position, a latch holdback subassembly that continuously holds the frog spring wing rail in its fully-opened position until deactivated, and a control means responsive to railcar wheel flanges passing through the frog assembly to automatically and with delay deactivate the latch holdback subassembly to thereby initiate release the frog spring wing rail from its flexed position after the last railcar wheel of passing train of railcars has cleared the frog assembly.

BRIEF DESCRIPTION OF THE DRAWINGS

FIG. 1 is a schematic plan view of a preferred embodiment of the railroad frog assembly of the present invention;

FIG. 3 is a section view taken at line 3—3 of FIG. 1; and

DETAILED DESCRIPTION

Figure 2:
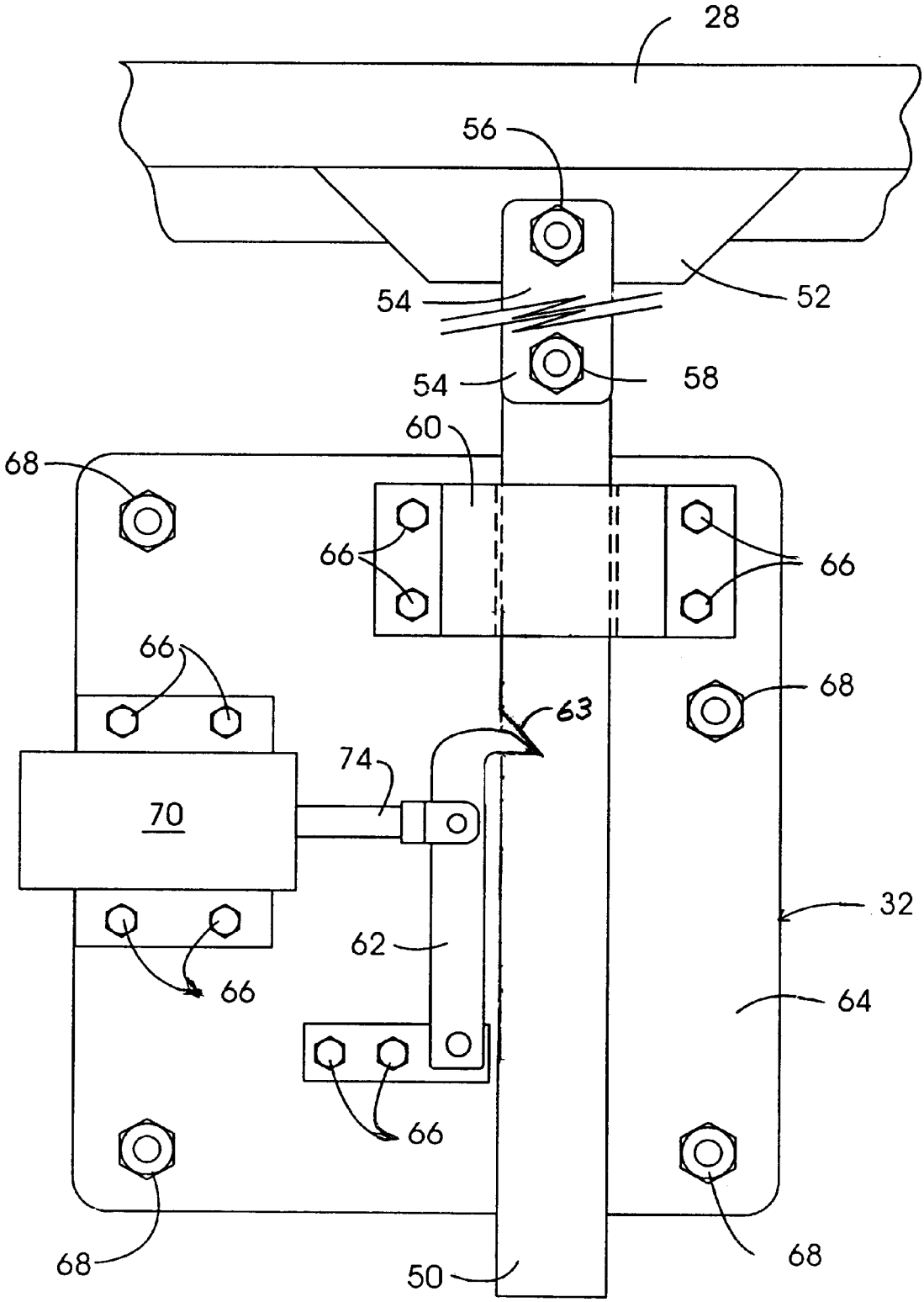
FIG. 2 is a fragmentary plan view of a portion of the FIG. 1 plan view but illustrating the included latch holdback subassembly at a larger scale.

FIG. 1 schematically illustrates a preferred embodiment of the present invention as a left-hand railroad trackwork spring wing rail frog assembly 10 installed at the intersection of a turnout traffic rail 12 and a railroad main traffic rail 14. Frog assembly 10 is basically comprised of a base plate element 22, a frog fixed point 26 (sometimes referred to as a frog "V-point") carried by the base plate, a laterally-movable frog spring wing rail 28, a frog fixed wing rail 30 also supported by base plate element 22, and a latch holdback subassembly 32 functionally connected to spring wing rail 28 and to base plate 22 as hereinafter described.

In FIGS. 1 frog assembly spring wing rail element 28 is illustrated in its closed position but when moved to a "fully open" position creates a cross-over flangeway through assembly 10 for the flanges of railcar wheels riding along turnout traffic rail 12. Spring wing rail element 28 essentially abuts the side of fixed point 26 when in its closed position, and is flexed or pivoted laterally about a fixed point to a fully-open position whenever the flange of a railcar wheel traversing frog assembly 10 either engages the side of closed flexible wing rail 28 to the right of V-point 26 or engages the side of movable wing rail element 28 at its flared end portion 38.

Also included in a typical railroad trackwork intersection, but not comprising a part of the present invention, is conventional intersection rigid guard rail 43. Also, conventional spring wing rail holddown subassemblies 34 and conventional supplementary compression spring closer elements (not shown) may optionally be incorporated into frog assembly 10 but are not the basis of the novelty of the present invention.

Spring wing rail frog assembly 10 also includes a control system 40 that is hydraulic in nature and that functions to regulate latch holdback subassembly 32 between its activated and deactivated conditions. Also, control system 40 is particularly distinguished by the inclusion of a wheel-activated, single-acting, spring-return mechanical hydraulic pump element 82 that functions both as a sensor of the presence or absence of each railcar wheel passing through frog assembly 10 and as an energy source for powering control system 40. FIG. 1 also shows, schematically, the preferred placement of wheel-activated hydraulic pump element 82 in a position that is adjacent outboard turnout traffic rail 18. Alternatively, a pair of such mechanical hydraulic pump elements may be utilized in a particular frog assembly installation such being located to each traffic side of frog assembly 10.

As shown in FIG. 2, latch holdback subassembly 32 is comprised of a notched rod element 50 that is connected to bracket 52 attached to spring wing rail section 28 through paired connecting links 54 and threaded pivot bolt fasteners 56 and 58, a co-operating rod-guide and holddown 60 which restrains rod element 50 relative to its principal axis both vertically and transversely but not longitudinally and slidably, and also a pivoted latch retention pawl element 62 which selectively engages and restrains rod element 50 against movement in one direction only when activated. Elements 60 and 62 are mounted on latch holdback base element 64 by threaded bolt fasteners 66. Base element 64 in turn is mounted on frog base plate element 22 by threaded fasteners 68.

Also included in latch holdback subassembly 32 is hydraulic actuator element 70 whose interior piston 72 and joined piston rod element 74 are spring-biased in a direction away from rod element 50 by internal compression spring 76. (See FIG. 4). Spring 76, in the absence of pressurized hydraulic fluid in the opposite interior end of actuator 70, functions to deactivate latch subassembly 32 by moving latch retention pawl 62 out of engagement with the single notch 63 of rod element 50. Actuator piston rod element 74 is pivotally attached at its free end to pivoted latch pawl element 62.

Spring wing rail 28 is moved to an open condition by engagement with a railcar wheel flange, and the concurrent pressurization of hydraulic control system 40 by the actuation of hydraulic pump element 82 by the wheels of the passing railcar, piston/piston rod combination 72–74 moves latch pawl element 62 into engagement with the notch 63 of rod element 50. All movement of the latch rod element in a spring wing rail-closing direction is restrained by latch pawl element 62 and its indirect connection to the frog assembly base plate 22 until such time as latch subassembly 32 is deactivated by substantially reducing the pressure of the hydraulic fluid previously generated within hydraulic actuator 70 by control system 40.

Figure 4:
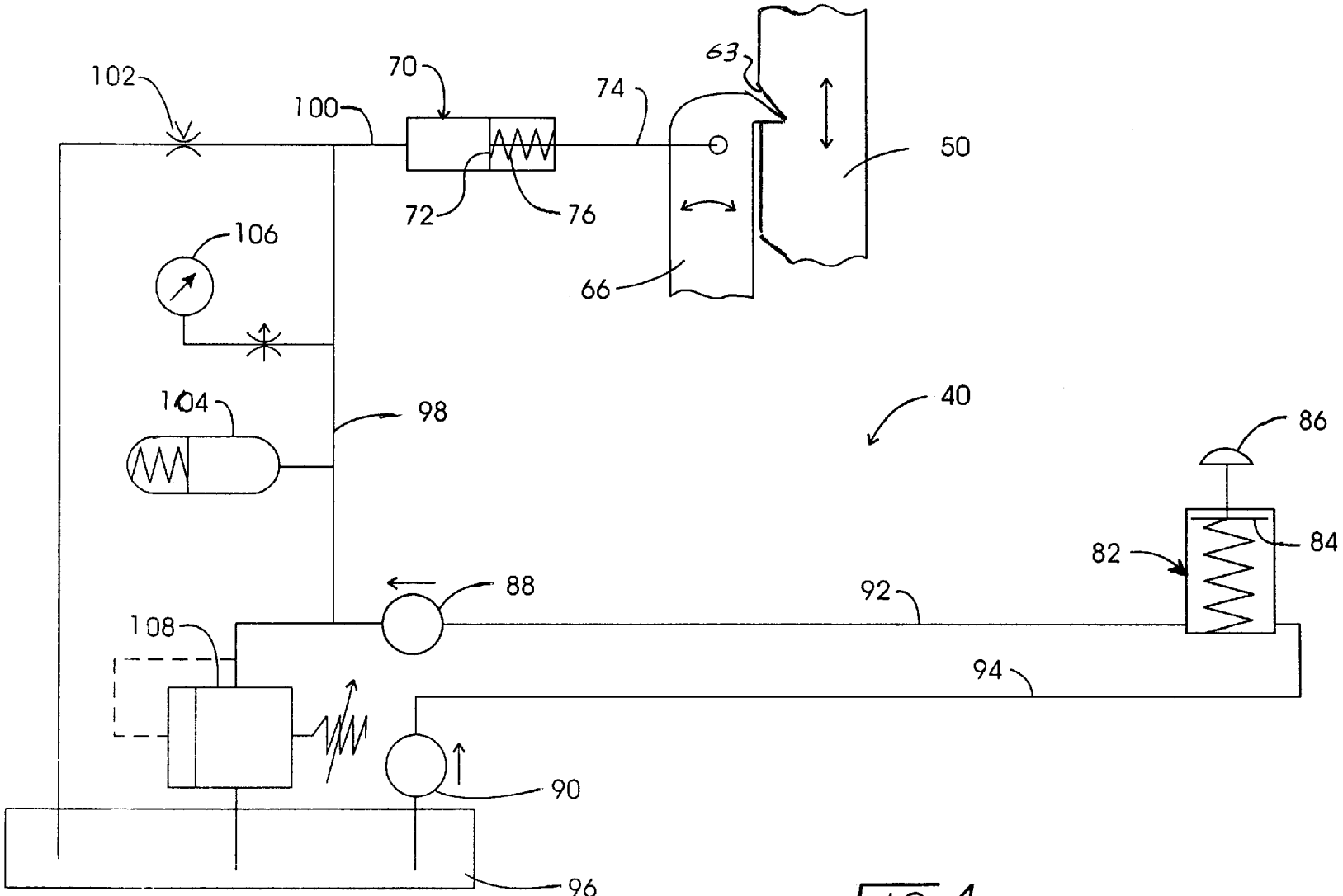
FIG. 4 schematically illustrates the hydraulic control system utilized with the railroad frog assembly of FIG. 1.

Details of hydraulic control system 40 are provided in FIG. 4 of the drawings. Hydraulic pump 82 has an internal piston 84 that is connected to reciprocable, wheel-actuated plunger element 86. Pump 82 is made a single-acting pump be reason of check valves 88 and 90 included in hydraulic fluid flow lines 92 and 94. The internal compression spring element of hydraulic pump 82, in the absence of wheel tread forces imposed on plunger element 86, urges piston element 84 to the position shown in FIG. 4.

As the wheel treads of successive railcars passing through frog assembly 10 repeatedly depress plunger element 86, pressurized hydraulic fluid is pumped from reservoir 96 to single-acting, spring-return hydraulic actuator 70 via fluid flow lines 98 and 100.

Hydraulic control system 40 also includes and adjustable bleed-off valve 102, a conventional spring-powered pressure accumulator 104, a valved pressure gage 106, and an adjustable pressure relief valve 108 set for system maximum pressure. System relief valve 108 is set to hold a control system activating pressure that is greater than the pressure required at actuator 70 to overcome the spring forces of actuator compression spring 76 and thereby maintain latch retention pawl element 62 actively engaged with the notch 63 of ratchet rod element 50 but not so high as to materially oppose the forces of latch rod element 50 that move that element in a spring wing rail-opening direction. Bleed-off valve 102 is preferably adjusted to control the rate of fluid flow from line 100 where such rate establishes a predetermined time delay (e.g., 45 seconds) between the time that the last railcar wheel of a train set passing through frog assembly 10 depresses pump plunger 86 and the time that latch subassembly 32 is returned to its fully-deactivated condition.

Various changes may be made in the relative shapes, proportions, and sizes of the components disclosed without departing from the scope, meaning, or intent of the claims which follow.

What is claimed is:

1. A railroad trackwork frog assembly comprising:

a frog fixed point element;

a frog base plate element, a frog spring wing rail element that may be flexed laterally from a closed position abutting said frog fixed point element to an open condition separated from said frog fixed point element by a minimum distance equal to the width of a railcar wheel flange;

a single-stop position ratchet latch holdback subassembly coupled to said frog spring wing rail element and to said frog base plate element, and continuously retaining said frog spring wing rail element in the spring wing rail element fully open condition when activated; and control means selectively deactivating said single-position ratchet latch holdback subassembly, said control means deactivating said single-stop position ratchet latch holdback subassembly following the passing of the last railcar wheel of each train passing through the frog assembly to thereby initiate spring return of the spring wing rail element from a fully open condition to a closed condition.

2. The railroad frog assembly defined by claim 1, and wherein said single-stop position ratchet latch holdback subassembly comprises a latch rod element coupled to said spring wing rail and having a notch, a latch retention pawl element pivotally carried by said frog base plate element and selectively engageable with said latch rod element notch, and an actuator element connected to said latch pawl element, said latch pawl element being engaged with said latch rod element notch when said single-stop position ratchet latch holdback subassembly is activated.

3. The railroad frog assembly defined by claim 2, and further comprised of a control system having a wheel-actuated hydraulic pump, said wheel-actuated hydraulic pump, when delivering pressurized hydraulic fluid, activating said single-position ratchet latch holdback subassembly and engaging said latch retention pawl element with said latch rod element notch.

* * * * *